United States Patent [19]

Zucchinelli

[11] 3,979,166

[45] Sept. 7, 1976

[54] GETTER DEVICE

[75] Inventor: Mario Zucchinelli, Milan, Italy

[73] Assignee: S.A.E.S. Getters S.p.A., Milan, Italy

[22] Filed: Feb. 12, 1975

[21] Appl. No.: 549,487

[30] Foreign Application Priority Data

Mar. 18, 1974 Italy ..... 86247/74

[52] U.S. Cl. ..... 417/48; 313/174

[51] Int. Cl.[2] ..... F04B 37/02

[58] Field of Search ..... 417/48; 313/176, 177, 313/181, 174; 315/108, 111

[56] References Cited

UNITED STATES PATENTS

| | | | |
|---|---|---|---|
| 2,824,640 | 2/1958 | Porta | 417/48 |
| 3,225,911 | 12/1965 | Porta | 417/48 |
| 3,385,420 | 5/1968 | Porta | 417/48 |

FOREIGN PATENTS OR APPLICATIONS

| | | | |
|---|---|---|---|
| 235,993 | 12/1959 | Australia | 417/48 |
| 1,276,747 | 10/1961 | France | 313/176 |

*Primary Examiner*—William L. Freeh
*Assistant Examiner*—Edward Look
*Attorney, Agent, or Firm*—Littlepage, Quaintance, Murphy & Dobyns

[57] ABSTRACT

A getter device having two rings with coextensive axes wherein the rings are in thermal contact one with the other.

8 Claims, 6 Drawing Figures

GETTER DEVICE

The present invention relates to an improved quick flash high yield getter device with means to prevent warping and break up of the getter material.

The use of getter devices in electron tubes is well known. In certain types of electron tubes, such as television kinescopes, for example, it is desirable to use a getter device which will produce a high yield of evaporated getter material in a very short time. In order to heat the getter device, to cause evaporation of the getter material, it is customary to use induction heating and so the getter device is usually constructed in the form of a closed loop, such as a disc or U-shaped ring channel container, supporting a compressed powdered evaporable getter material.

See, for example, U.S. Pat. No. 2,824,640 and U.S. Pat. No. 3,225,911.

The evaporable getter material generally comprises an alkali earth metal such as magnesium, strontium, or barium or their alloys. The most commonly used evaporable getter material is an alloy of barium with aluminum containing about 50–56% barium by weight. It is frequently desirable to mix this barium-aluminum alloy with another material such that upon heating an exothermic chemical reaction takes place with release of barium vapor. Very often the material chosen is nickel which is added in an approximate ratio by weight of from 2:1 to 1:2 and preferably in a ratio of 1:1 with the barium aluminum alloy. Thus, the exothermic evaporable getter material mixture contains about 25% by weight of barium.

Very frequently there is also added a small percentage of gas-releasing material such as $Fe_4N$ or the hydrides of Ti or Zr.

In large size electron tubes and particularly in color television picture tubes it is common to use up to about 250mg of barium so as to insure satisfactory gettering properties and a long cathode life. The use of 250mg of barium implies that the getter device must contain about 1000mg of exothermic evaporable getter material. When such a large amount of getter material is disposed in a U-shaped channel holder several disadvantages may occur.

It has been found that if the thickness of the evaporable getter material, pressed into the U-channel holder, is too great there is a serious loss of yield as much less than 100% of the theoretical barium content is evaporated upon heating with the normal flashing times.

In order to reduce this thickness it has become common to use a U-channel holder with a wide channel. The wide channel allows a larger surface area of the evaporable getter material to be exposed thus facilitating barium evaporation upon heating. Unfortunately, the use of a wide channel has resulted in a further problem. There is a tendency for the getter material to crack and detach or lift from the container. This can result in loose particles being released from the getter container which can cause short circuits in the electrode structure or block the electron transparent holes in a color TV shadow mask. Furthermore, lifting of the evaporable getter material alters the thermal properties of the getter device and can lead to localized overheating and melting of the getter container. Much effort has been spent in trying to overcome these problems and to obtain a high yield quick flash getter device.

Della Porta et al in U.S. Pat. No. 3,385,420 propose the use of a getter container which allows a plurality of the evaporable getter material surfaces to be exposed. However, such devices can be complicated to make and usually require the use of barium vapor reflecting elements which add to the cost and weight of the device.

King in U.S. Pat. No. 2,183,841 also proposed an increase in the surface area to overcome certain problems but his resulting device becomes cumbersome. Furthermore, he is not concerned with eliminating the lifting of getter material from a wide channel getter device.

Scott in U.S. Pat. No. 3,457,448 provides the getter device with a reinforcing means such as a bead formed in the outer wall of the U-channel support. Such beads are difficult to form in a reproducible manner and lifting of the getter material still occurs.

Reash in U.S. Pat. No. 3,428,168 also provides a reinforcing means in the form of a wire or L-shaped annular metallic element placed within the getter holder.

Unfortunately, prior attempts to reduce the propensity of the evaporable getter material to lift or detach itself from the support have met with only limited success.

Accordingly, it is an object of the present invention to provide a getter device substantially free of one or more of the disadvantages of prior getter devices.

Another object is to provide an improved getter device in which separation of getter material from the holder is minimized.

A further object is to provide an improved getter device which has a reduced tendency to release loose particles.

A still further object of the present invention is to provide an improved getter device accomplishing the above objects without adversely affecting other properties such as the amount of getter metal released.

Yet another object is to provide an improved process for producing a getter device.

Additional objects and advantages of the present invention will be apparent to those skilled in the art by reference to the following detailed description and drawings wherein.

According to the present invention there is provided a getter device for releasing an evaporable getter metal in a vacuum tube comprising a first ring, a compressed particulate getter metal releasing material attached to said first ring, a second ring, a compressed particulate getter metal releasing material attached to said second ring, wherein the axes perpendicular to the planes of the first and second rings are substantially coextensive and the rings are in thermal contact one with the other.

In the broadest sense of the invention the two rings may be of any size suitable for being placed in thermal contact with each other. However, it is perferable if the rings have one diameter of the same size. For example, the external diameters may be equal. Alternatively the internal diameters may be equal.

When at least one diameter is equal it is found that the two rings are easily attached in thermal contact and that no obstacle is created to the evaporation of getter material.

Furthermore, if the external diameters are equal the rings can contain the maximum amount of getter material and are easily heated by induction heating. In a further preferred embodiment at least one of the rings may have openings in its bottom wall.

Figure 1:
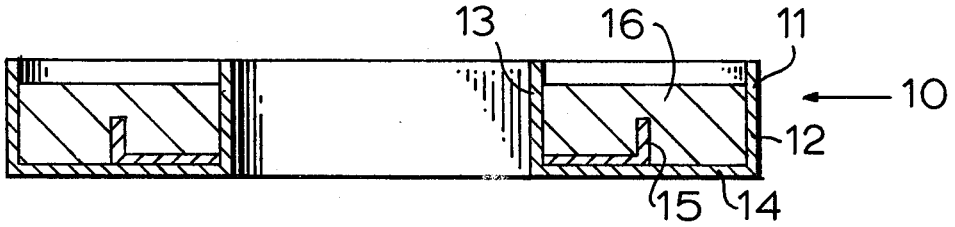
FIG. 1 PRIOR ART
FIG. 1 is a sectional view of a prior art getter device forming no part of the present invention.

Referring now to the drawings and in particular to FIG. 1 there is shown a known getter device 10 comprising a ring container 11 having an outer wall 12, an inner wall 13, and a bottom wall 14 joining outer wall 12 to inner wall 13.

An insert member 15 having an L-shaped section is contained within the ring container 11 and attempts to retain a filling of getter material 16 within ring 11.

Figure 2:
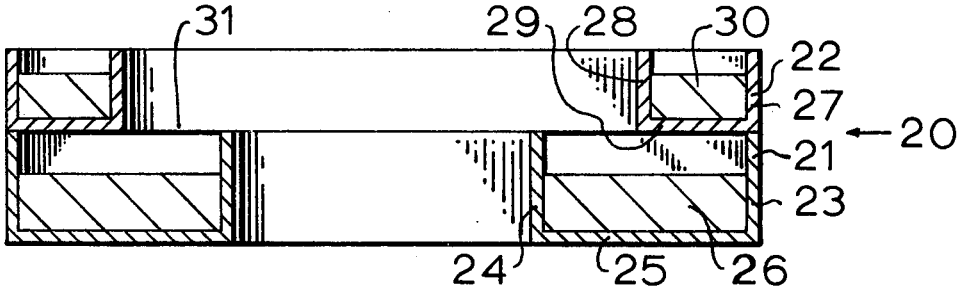
FIG. 2 is a cross-sectional view of a preferred getter device of the present invention.
Figure 3:
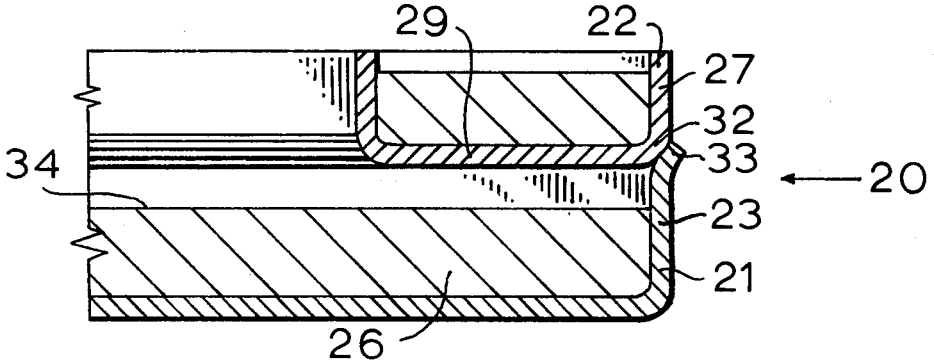
FIG. 3 is an enlarged portion of the getter device of FIG. 2.

FIG. 2 shows a getter device 20 comprising a first ring 21 and a second ring 22. First ring 21 comprises an outer wall 23, an inner wall 24 and a bottom wall 25 joining said inner wall to said outer wall. Within ring 21 is placed a filling of getter material 26. Second ring 22 comprises an outer wall 27, an inner wall 28, and a bottom wall 29 joining said inner wall to said outer wall. Within ring 22 is placed a filling of getter material 30. The outer diameters of rings 21 and 22 are substantially equal whereas the inner diameter of ring 22 is larger than that of ring 21. Thus, a space 31 is left above ring 21 for the free exit of getter metal vapors upon heating the getter metal vapor-releasing material 26 contained in ring 21. FIG. 3 shows an enlarged portion of getter device 20. Bottom wall 29 or ring 22 is joined to outer wall 27 by a curved portion 32. Upper end 33 of outer wall 23 of ring 21 is in thermal contact with curved portion 32. If desired upper end 33 may be flared outwards slightly to allow a slightly better seating of ring 22. Bottom wall 29 is distanced from upper surface 34 of evaporable getter material 26 contained within ring 21.

Figure 4:
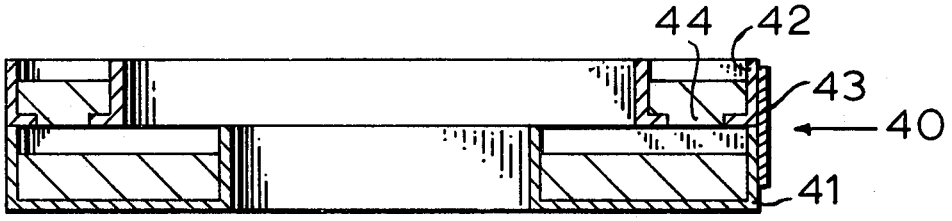
FIG. 4 is a cross-sectional view of another perferred getter device of the present invention.

FIG. 4 shows a getter device 40 of the present invention wherein a first ring 41 is attached to a second ring 42 by means of a small strip 43 of metal spot welded to the outer walls of both rings at positions remote from the contact of evaporable getter material with said outer walls. Second ring 42 has openings 44 in its bottom wall.

Figure 5:
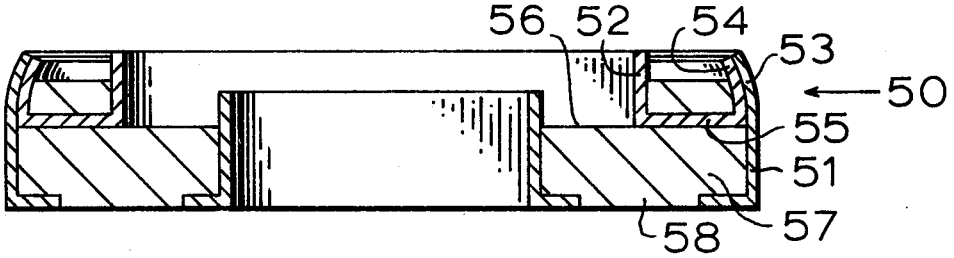
FIGS. 5 and 6 are cross-sectional views of alternative embodiments of getter devices of the present invention.
Figure 6:
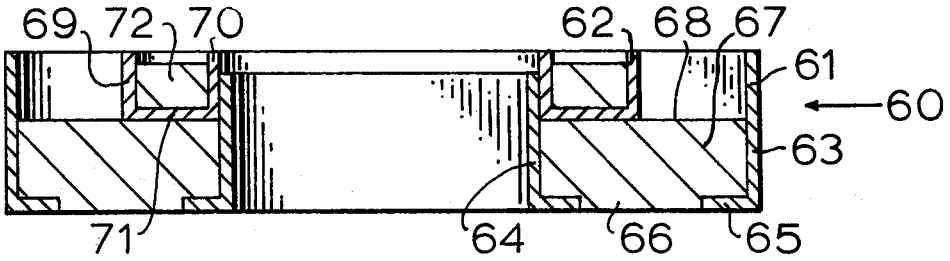

FIG. 5 shows a sectional view of a getter device 50 of the present invention. Said device comprises a first ring 51 and a second ring 52 outer wall 53 of first ring 51 is in contact with outer wall 54 of second ring 52. Bottom wall 55 of second ring 52 is in contact with upper surface 56 of evaporable getter material 57 contained within ring 51. Ring 51 has holes 58 in its bottom wall. Outer wall 53 is bent inwards slightly to entrap ring 52 firmly in position. FIG. 6 shows a sectional view of another embodiment in the form of a getter device 60. Getter device 60 comprises a first ring 61 and a second ring 62. First ring 61 comprises an outer wall 63, an inner wall 64, and a bottom wall 65. Bottom wall 65 contains holes 66.

The first ring 61 is filled with evaporable getter material 67 having an upper surface 68. The second ring 62 comprises an outer wall 69, an inner wall 70, and a bottom wall 71. Second ring 62 is filled with evaporable getter material 72. Bottom wall 71 of second ring 62 is in contact with upper surface 68 of getter material 67 filling first ring 61.

Inner wall 70 of second ring 62 is in thermal contact with inner wall 64 of first ring 61. The outer radius of second ring 62 is less than the outer radius of first ring 61.

The invention is further illustrated by the following examples in which all parts and percentages are by weight unless otherwise indicated. These non-limiting examples are illustrative of certain embodiments designed to teach those skilled in the art how to practice the invention and to represent the best mode contemplated for carrying out the invention.

EXAMPLE 1

This comparative example is not illustrative of the present invention but rather illustrates problems experienced in prior devices.

A powdered alloy of barium and aluminum containing between 50–56% barium are mixed with approximately 50% of powdered nickel. Twelve hundred milligrams of this powder is placed in a U-shaped channel ring container of outside diameter 20mm and inside diameter 10mm. The getter device is placed in a vacuum chamber and heated by induction heating such that barium starts to evaporate after about 10 seconds. Heating is continued until 30 seconds after the start of heating. The test is repeated 10 times. All 10 getter devices show evident signs of getter material lifting out of the channel. The barium yield is less than the theoretical yield of 300mg.

EXAMPLE 2

A getter device is constructed as shown in FIG. 2 of the attached drawing. The first U-shaped channel ring is identical in all respects to that of Example 1. The second U-shaped channel ring has an outside diameter equal to that of the first ring but has a channel width only half that of the first channel. The first ring is filled with 760mg of the powdered barium aluminum alloy mixed with nickel. The second ring is filled with 440mg of the powdered mixture such that 1200mg of mixture is distributed between the two rings so as to make the thickness of powder in the rings approximately equal.

This getter device is placed in a vacuum chamber and heated by induction heating such that barium starts to be evaporated after about 10 seconds. Heating is maintained until 30 seconds after the start of heating. The test is repeated 10 times. No getter devices show lifting of getter material from the channel.

Although the invention has been described in considerable detail with reference to certain preferred embodiments thereof it will be understood that variations and modifications can be effected within the spirit and scope of the invention as described above and as defined in the appended claims.

What is claimed is:

1. A getter device for releasing an evaporable getter metal in a vacuum tube, said device comprising:

A. a first U-shaped cross-section annular ring, having a bottom wall attached to inner and outer side walls, B. a compressed particulate getter metal releasing material attached to said ring, C. a second U-shaped cross-section annular ring, having a bottom wall attached to inner and outer side walls, D. a compressed particulate getter metal releasing material attached to said second ring, whereby the axes of the first and second rings are substantially co-extensive and the rings are in heat conducting contact one with the other in which the external radii of both annular rings are substantially equal and the inside diameter of the second annular ring is greater than the inside diameter of the first annular ring.

2. A getter device of claim 1 in which the first U-shaped cross section annular ring comprises an outer wall, an inner wall and a bottom wall joining said outer wall to said inner wall.

3. A getter device of claim 2 in which the bottom wall contains holes.

4. A getter device of claim 1 in which the second U-shaped cross-section annular ring comprises an outer wall, an inner wall and a bottom wall joining said outer wall to said inner wall.

5. A getter device of claim 1 in which the particulate getter metal releasing material comprises an alloy of barium and aluminum.

6. A getter device of claim 1 in which the particulate getter metal releasing material comprises:

A. an alloy of 50–56% barium by weight, balance aluminum admixed with

B. nickel, where the weight ratio A:B is from 2:1 to 1:2.

7. A getter device for releasing an evaporable getter metal in a vacuum tube, said device comprising:

A. a first U-shaped cross-section annular ring, having a bottom wall attached to inner and outer side walls, B. a compressed particulate getter metal releasing material attached to said ring, C. a second U-shaped cross-section annular ring, having a bottom wall attached to inner and outer side walls, D. a compressed particulate getter metal releasing material attached to said second ring, whereby the axes of the first and second rings are substantially co-extensive and the rings are in heat conducting contact one with the other in which the internal radii of both annular rings are substantially equal and the outside diameter of the second annular ring is less than the outside diameter of the first annular ring.

8. A getter device for releasing an evaporable getter metal in a vacuum tube, said device comprising:

A. a first U-shaped cross-section annular ring comprising:

1. an outer wall
2. an inner wall
3. a bottom wall joining said outer wall to said inner wall, B. a compressed particulate getter metal releasing material comprising a barium-aluminum alloy within said first ring, C. a second U-shaped cross-section annular ring comprising:

1. an outer wall
2. an inner wall
3. a bottom wall joining said outer wall to said inner wall, D. a compressed particulate getter metal releasing material comprising a barium-aluminum alloy within said second ring, wherein the outer radii of the two rings are substantially equal and the inner radius of the first ring is less than the inner radius of the second ring;

wherein the two rings are placed with their axes substantially coextensive, the second ring having its bottom wall facing the opening defined by the inner wall and outer walls of the first ring, the two rings being in heat conducting contact one with the other.

* * * * *